United States Patent [19]

Engelbrecht

[11] Patent Number: 4,728,070

[45] Date of Patent: Mar. 1, 1988

[54] BAG HOLDER

[76] Inventor: Billy L. Engelbrecht, 910 S. 39th St., Manitowoc, Wis. 54220

[21] Appl. No.: 8,284

[22] Filed: Jan. 29, 1987

[51] Int. Cl.[4] ..... B65D 90/04

[52] U.S. Cl. ..... 248/303; 248/100; 248/221.1; 220/1 T; 220/404

[58] Field of Search ..... 248/95, 97, 99, 100, 248/121, 153, 175, 213.2, 221.1, 222.2, 225.2, 302, 303, 359 R, 359 G, 360; 383/33; 220/1 T, 403, 404; 53/390; 141/391

[56] References Cited

U.S. PATENT DOCUMENTS

| | | | |
|---|---|---|---|
| 1,103,491 | 7/1914 | Cormier | 248/302 |
| 2,761,644 | 9/1956 | Capocci | 248/303 |
| 2,872,145 | 2/1959 | Goldsholl | 248/221.1 |
| 3,195,731 | 7/1965 | Bomar | 248/221.1 |
| 3,226,072 | 12/1965 | Johnson | 248/221.1 |
| 4,332,361 | 6/1982 | McClellan | 248/95 |
| 4,418,835 | 12/1983 | Watts | 248/100 |
| 4,558,800 | 12/1985 | Isgar | 248/95 |
| 4,576,310 | 3/1986 | Isgar | 220/403 |
| 4,664,347 | 5/1987 | Brown | 220/1 T |

FOREIGN PATENT DOCUMENTS

| | | | |
|---|---|---|---|
| 1473045 | 2/1967 | France | 248/222.2 |
| 21645 | of 1904 | United Kingdom | 248/303 |

*Primary Examiner*—J. Franklin Foss
*Assistant Examiner*—Robert A. Olson

[57] ABSTRACT

A holder, for supporting a thin, collapsible, self-handle, plastic trash bag, is made of a continuous piece of small-diameter wire, bent into a generally "U"-shaped configuration with a prong and hooks. The holder is designed to fit into a plurality of small holes in the side of a trash container so that the assembly may be made without any fasteners or adhesives, and so that the holder may be removed for transfer to and use with more than one trash container.

5 Claims, 5 Drawing Figures

BAG HOLDER

BACKGROUND OF THE INVENTION

The present invention relates to a bag holder and, particularly, a container, a holder, and an assembly of a thin, flexible, collapsible plastic trash bag within a rigid wastepaper basket or the like.

In many households, a rectangular plastic or metal basket or can is used in the kitchen or elsewhere, to hold refuse and trash, and in the past that container has usually been lined with a discarded flat-bottom, self-standing paper sack in which the purchases had been brought home from the grocery store. More recently commercially-available plastic trash-can liners have been made and sold by such companies as Presto, Exxon, Union Carbide, Mobil and others. However, these are large bags which depend for support by being folded over the top edge of the basket or can and, though satisfactory for outdoor use, are unsatisfactory when used indoors. After the bag is filled, it is removed from the plastic container and discarded with the trash.

It would appear that nothing could be simpler, until, in more recent times, the flat-bottom, free-standing paper sack has been replaced by the less expensive, thin-gauge plastic handle-bag, which is less bulky, less expensive and, in many cases, stronger than the paper bag.

This bag is generally hung by the handles in a stand or bracket in a grocery store, while the purchases are placed therein, and the bag (and contents) then carried away from the store with the customer carrying it by the self-formed handles in the plastic bag.

Such a container is easier to carry than a paper sack filled with heavy cans, fruits, vegetables, and the like, but it has one disadvantage. Because of its thin, flexible nature, it collapses and is not free-standing and, therefore, must be hung or otherwise supported by the handles if it is to be re-used.

The present invention relates to a bracket-arrangement which can be fitted easily to the wide variety of household containers presently in use throughout the nation, and it also has the advantage of being easily and inexpensively provided by the container manufacturer of "original equipment" and either installed at the factory by the manufacturer or subsequently installed by the purchaser of the container.

Others have tried to solve the problem, and I refer particularly to U.S. Pat. Nos. 4,332,361; 4,418,835; and 4,558,800.

U.S. Pat. No. 4,418,835 issued to Watts on Dec. 6, 1983 shows a wire-like arrangement which can be fitted to a household trash container, but such device must be mechanically fastened by screws to the thin inner wall of the container, and may easily be rendered unusable if the seams pull out of the side wall.

In U.S. Pat. No. 4,558,800 issued to Isgar on Dec. 17, 1985, another method of solving the problem was approached, but in this case an expensive, flat side-wall or plate of the attachments must be secured to the inner sidewall of the container with costly adhesive devices.

In U.S. Pat. No. 4,332,361 issued to McClellum on June 1, 1982, the inventor attempted to solve the problem by screwing a portion of the wire bracket to a rigid support and then providing wire sprung-clamps which pivot on the bracket to hold the bag-handles in place.

Such arrangement is similarly more expensive than is justified for the problem to be solved.

SUMMARY OF THE INVENTION

The present invention includes a pair of simple bent-wire hook-like brackets which can be formed inexpensively of low-cost wire and, because of the peculiar twists, bends and displacement of the wire, the device will effectively and securely hold a thin, flexible handle-bag in place within a trash container. All that is required is to provide three holes on each of the opposed sidewalls of the container, disposed in appropriate placement with respect to each other, so that prongs of the brackets of the present invention can pass therethrough. Furthermore, the holder of the present invention can be removed easily from one trash basket and attached to a new or different basket having similar holes in the sidewalls thereof.

With the foregoing in mind, an object of the present invention is to provide a bracket-hanger arrangement in a household trash container, which can be simply and inexpensively constructed and easily installed by the homeowner.

Another object of the present invention is to provide a pair of brackets which can be supplied by the manufacturers of household trash containers for attachment to the trash container to hold a thin, flexible, plastic handle-bag within the container as a liner, and for reception of the trash while the bag is hanging within the trash container.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrrangements and organizations of the instrumentalities as herein shown and described.

Figure 1:
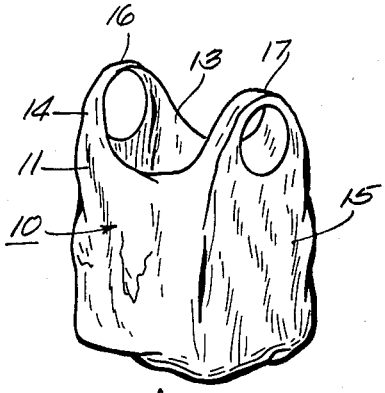
FIG. 1 is a perspective view of a thin, flexible plastic handle bag.

In FIG. 1, a plastic bag 10, which is usually formed from tubular blown, low-cost polyethylene or the like, has a body 11, with a bottom 12, and an upper opening 13, defining two side portions 14 and 15 with handles 16 and 17 therein. Such a bag is well-known in the trade and has been well described in the art and, in fact, is illustrated in the three U.S. Patents referred to earlier in this description.

Figure 3:
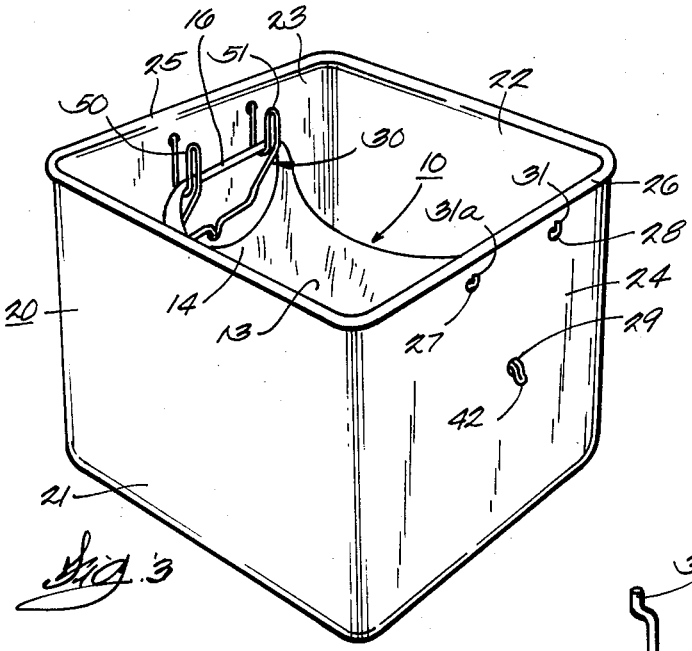
FIG. 3 is a perspective view of a trash container with a pair of the hangers fitted thereto, and with a plastic sack like that shown in FIG. 1 hanging within the container.

The trash container 20, shown in FIG. 3, found in many of the homes in the nation, is generally a rectangular box-like structure having front and backwalls 21 and 22, and sidewalls 23 and 24. In many instances, it comes provided with a cover (not shown) which may be pivotally or otherwise placed upon the upper edges 25 and 26 of the sidewalls 23 and 24.

In each of the sidewalls, three holes are formed as at 27, 28 and 29 in the side panel 24. Although the following description relates to the one side panel 24, it is to be understood that a similar arrangement of holes is placed in the other side panel 23.

Two of the holes, i.e., 27 and 28, are placed near the upper edge 26 of the side panel 24, but displaced below that edge sufficiently so that the wire hanger hereinafter described will not extend above the upper edge 26. These holes are horizontally in line with each other and generally parallel to the floor or other surface in which the container 20 is adapted to rest.

The third hole 29 is disposed below and between the holes 27 and 28 and sufficiently therebeneath so that the locking prong 42 of a wire bracket 30 can easily enter therethrough. As will be seen hereinafter, the hole 29 is somewhat larger in diameter than the holes 27 and 28.

Figure 2:
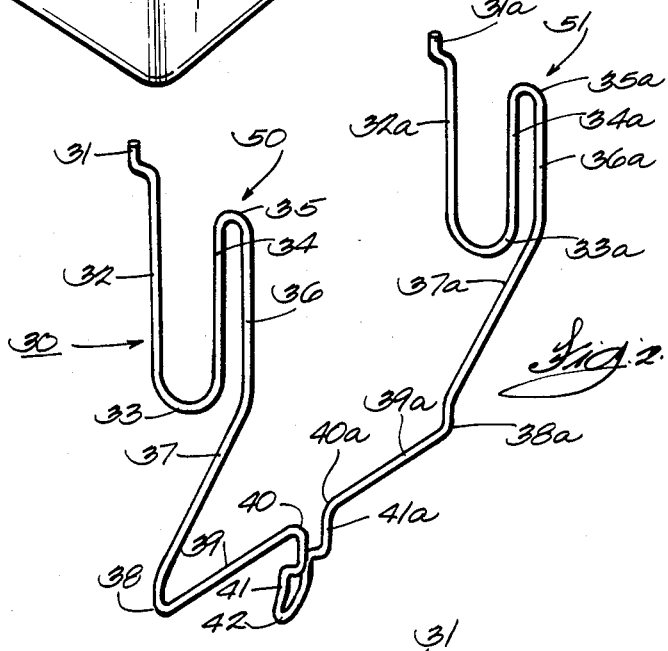
FIG. 2 is a perspective view of one of the pair of hangers or brackets of the present invention.
Figure 4:
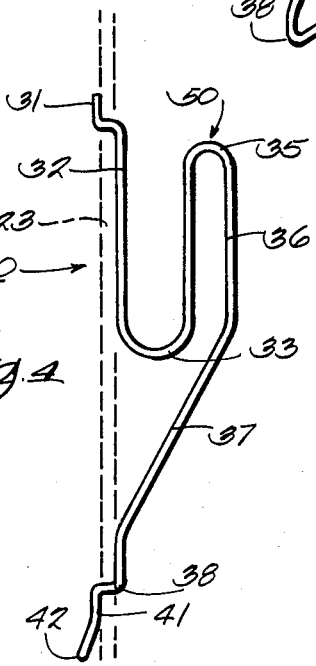
FIG. 4 is a side-elevational view of one of the pair of brackets.
Figure 5:
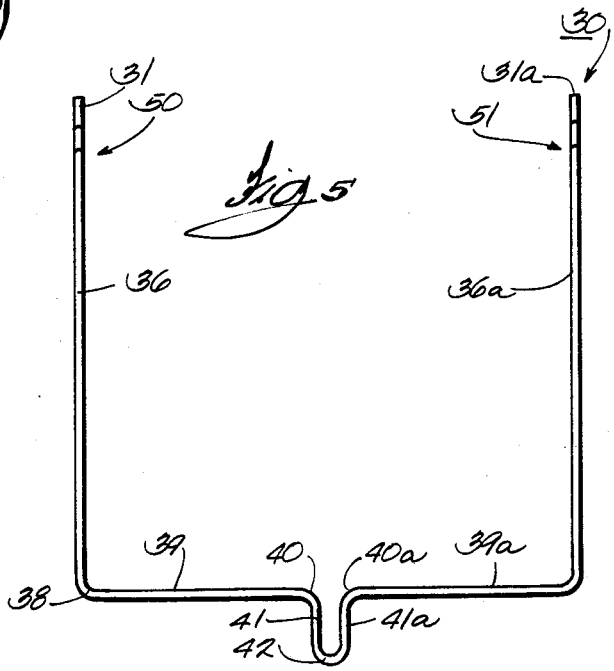
FIG. 5 is a front elevational view of one of the pair of wire brackets.

Referring now to FIGS. 2, 4, and 5, there is shown one (of the pair) of brackets 30, which is formed from a continuous length of small diameter wire. The wire is preferably made of cold drawn, spring steel which is resilient. This wire may be of any material desired, but preferably should be non-rusting, such as stainless steel, so that it will not deteriorate in the presence of the contents of a trash bag or if it comes in contact with the trash contents placed into the plastic bag 10.

The hanger or bracket 30 is formed in such a way as to provide a pair of S-shaped prongs 31, which are disposed above a vertical portion of a downwardly extending leg 32. The vertical portion 32 has formed therein a bend 33, at which point the wire reverses direction and extends upwardly as at 34 until it is bent once again at 35 into a downward direction to provide the leg 36. The downward extension 36 extends below the bend 33, and at 37 is bent backwardly to come into vertical alignment with the portion 32. At the bottom 38 of the leg 37, the wire is bent generally at a right angle toward the center of the hanger 30 to form a horizontal leg portion 39. At point 40, it once again is bent downwardly to form the leg 41, which terminates in the "U"-shaped locking prong 42.

The other half of the bracket 30 is identified by similar numbers with the letter "a" because they are replications of the previously described portions of the hanger or bracket.

Thus there is provided a hanger which has two upstanding fingers 50 and 51, which are held in place against the inner surface of the sidewalls of the container 20, when the two "S" shaped prongs 31 and **31*a* are placed in the holes 27 and 28. Thereafter, the bracket is bent slightly so as to enable the prong 42 to pass through the hole 29 where it snaps into place (on the outside of the sidewall 23 or 24**) so as to "lock" the bracket in place.

The "S" shaped portions 31 and **31*a* are firmly secured in the holes 27 and 28, so that the upper end of the hanger can neither move in or out of, nor up or down in the holes. This is important because the weight of the sack and contents hanging on the fingers 50 and 51 tend to pull the hooks out of the holes 27 and 28. Additionally, when the bag filled with trash is removed from the container 30, it tends to drag or rub against the brackets 30 while being removed from the container 20, and the bent prong 42 prevents the lower end 41 of the hanger from being pulled out of the hole 29**.

In FIG. 3, the two hangers are shown in position in the trash container 20 with a plastic sack 10 hanging therefrom.

The simple construction of these hangers enables them to be fabricated inexpensively and sold at a low price so that they will be affordable, not only by the householder who already has a container 20 which he or she would like to have converted for use with plastic bags 10 instead of the paper sacks, but also can be provided as "original equipment" by the manufacturer of the container when they are sold to the hardware stores or other retail establishments.

It is to be understood that the present invention may be embodied in other specific forms without departing from the spirit or special attributes hereof, and it is therefore desired that the present embodiments be considered in all respects as illustrative, and therefore not restrictive, reference being made to the appended Claims rather than to the foregoing description to indicate the scope of the invention.

Having thus described my invention, what I claim as new and desire to protect by Letters Patent are the following:

1. A holder for supporting a flexible, collapsible handle-bag in a trash container, said holder consisting entirely of a single continuous piece of wire, said wire being bent to form (a) a pair of horizontally spaced upper support prongs
(b) a leg extending downwardly from each prong
(c) an upstanding finger connected to each leg and spaced horizontally from the plane of the legs
(d) a downward extension extending from each finger and ending in the plane of the legs
(e) a lower locking prong connecting the extensions.

2. The holder of claim 1 wherein said support prongs are the ends of the piece of wire.

3. A pair of holders of claim 1 in combination with a trash container consisting of (a) a rigid container having an open top, front, back and two sidewalls
(b) three holes in each of said sidewalls.

4. The holder of claim 1 wherein said support prongs are S-shaped.

5. The holder of claim 1 wherein said locking prong is U-shaped.

* * * * *